US006070639A

United States Patent [19]

Winston et al.

[11] Patent Number: 6,070,639

[45] Date of Patent: Jun. 6, 2000

[54] WINDOW SHADE ASSEMBLY

[76] Inventors: Harold M. Winston; Patricia E. Winston, both of 7722 N. Marshfield Ave., Chicago, Ill. 60626

[21] Appl. No.: 09/148,291

[22] Filed: Sep. 4, 1998

[51] Int. Cl.[7] ..... A47H 1/00

[52] U.S. Cl. ..... 160/120; 160/25; 160/94; 160/127

[58] Field of Search ..... 160/23.1, 25, 34, 160/94, 109, 115, 120, 123, 126, 133, 160, 164, 166.1 R, 172.1 R, 178.1 R, 178.2 R, 241, 242, 264, 291, 127, 323.1, 370.22, 370.21

[56] References Cited

U.S. PATENT DOCUMENTS

| | | | |
|---|---|---|---|
| 1,108,681 | 8/1914 | Berchtold | 160/120 |
| 1,130,848 | 3/1915 | Seward | 160/120 |
| 2,112,206 | 3/1938 | Clavey | 160/120 |
| 2,126,328 | 8/1938 | Higby | 160/120 |
| 2,137,426 | 11/1938 | Thompson | 160/120 |
| 2,142,822 | 1/1939 | Moore | 160/120 |
| 2,280,358 | 4/1942 | Tietig | 160/120 |
| 2,336,692 | 12/1943 | Lubetsky | 160/120 |
| 2,359,906 | 10/1944 | Gerdner et al. | 160/94 |
| 2,395,073 | 2/1946 | Schepmoes | 160/127 |
| 2,467,431 | 4/1949 | Kellogg | 160/34 |
| 3,308,872 | 3/1967 | Smith | 160/120 |
| 3,420,487 | 1/1969 | Larsen | 160/120 |
| 4,020,889 | 5/1977 | Karoll | 160/120 |
| 4,369,829 | 1/1983 | Casiday | 160/120 |
| 5,647,421 | 7/1997 | Hoffman et al. | 160/120 |

*Primary Examiner*—Daniel P. Stodola
*Assistant Examiner*—Bruce A. Lev
*Attorney, Agent, or Firm*—Paul H. Gallagher

[57] ABSTRACT

A main opaque shade, and one or more translucent shades, all on rollers, and capable of being individually drawn and retracted. They are positioned as in layers fore to fore and spaced from inner to outer positions, with the opaque shade outermost. The translucent shades let substantial light through and have patterns or figures thereon to cast patterns in the inner space. When more than one translucent shade is used, they can be adjusted toward and from the main opaque shade.

14 Claims, 4 Drawing Sheets

WINDOW SHADE ASSEMBLY

FIELD OF THE INVENTION

The invention relates to roller shade means for use in a window in a wall between the exterior and a room or enclosed space.

SUMMARY OF THE INVENTION

The device of the invention is an assembly of roller shades, which includes a main opaque shade and a decorative shade. The main opaque shade serves the usual purpose of shutting out light from the exterior to the room, or nearly so, and the decorative shade is for the purpose of displaying a pattern in the room.

The decorative shade is translucent, and includes an artistic pattern therein. The decorative shade is in the form of a film, similar to that used in photography, and is capable of letting light through according to the pattern. Elements of the pattern may be relatively darker and lighter for letting through less and more light according to the pattern for casting a pattern or picture in the room.

The main opaque shade, and the decorative shade, can be selectively put in use, each independently of the other. When it is desired to shut out the light entirely, the main opaque shade is drawn to a closed position, and the decorative shade is retracted to inactive position.

The assembly is very simple in construction, and can be mounted in a window frame without altering the structure of the frame, or the wall in which it is mounted.

Another feature is that the simplicity of the device renders it inconspicuous, when the decorative shade is not in use.

Another feature is that a plurality of decorative shades, may be used in the assembly in conjunction with a single main opaque shade.

Still another feature is that the invention is of such broad scope, that a plurality of decorative shades can be mounted together in a swinging lever mechanism for individually and selectively utilizing the decorative shades so as to utilize a minimum of space notwithstanding that a plurality of decorative shades are incorporated in the assembly.

An additional feature is a construction wherein the usual brackets holding the main opaque shade are recessed into the window frame for positioning the side edges of the main opaque shade closely adjacent the window frame to shut out a maximum of light from the exterior.

A further feature is a novel cover for covering the assembly and protecting it from stray particles.

BRIEF DESCRIPTIONS OF THE FIGURES OF THE DRAWINGS

Figure 5:
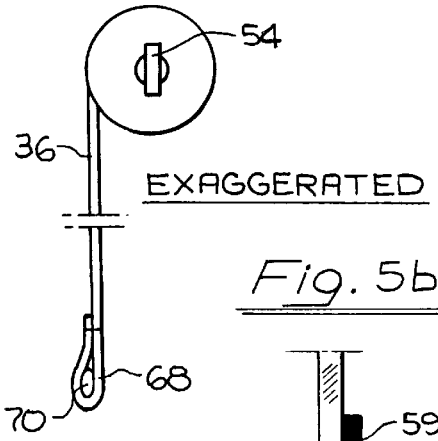
FIG. 5 is a view taken at line 5—5 of FIG. 1.
Figure 5B:
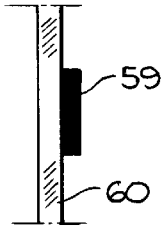
Figure 5A:
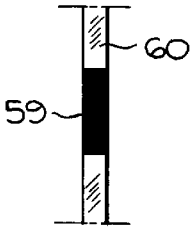

FIG. 5*a* is a fragmentary sectional view of a decorative window shade made of photographic film.

FIG. 5*b* is a fragmentary sectional view of a decorative window shade made of a clear element with paint deposited thereon.

Figure 6:
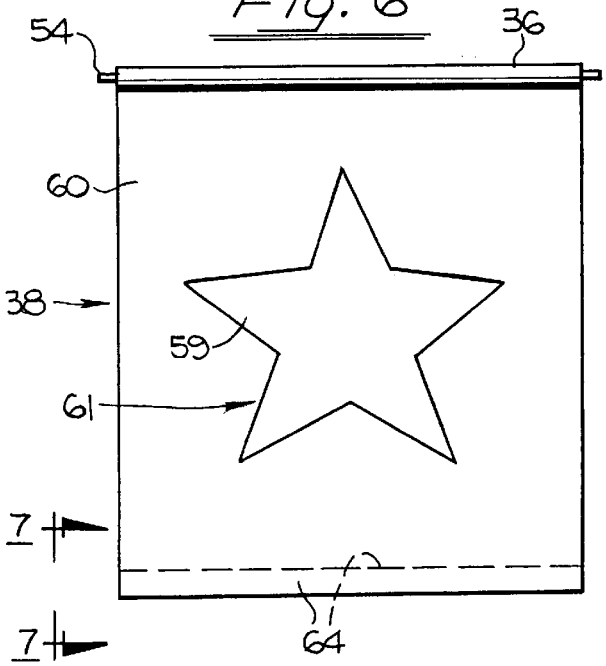

FIG. 6 is a face view of a decorative shade showing various decorative and artistic items thereon.

Figure 6A:
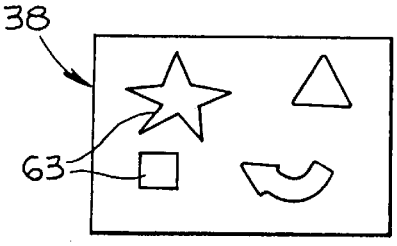

FIG. 6*a* shows an alternate form of patterns on the decorative shade.

Figure 7:
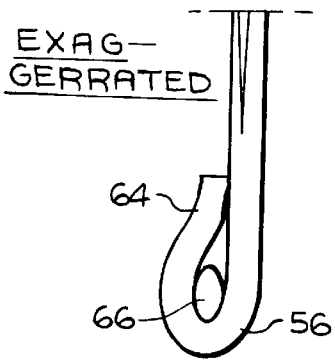

FIG. 7 is a view taken at line 7—7 of FIG. 6 on a larger scale.

Figure 2:
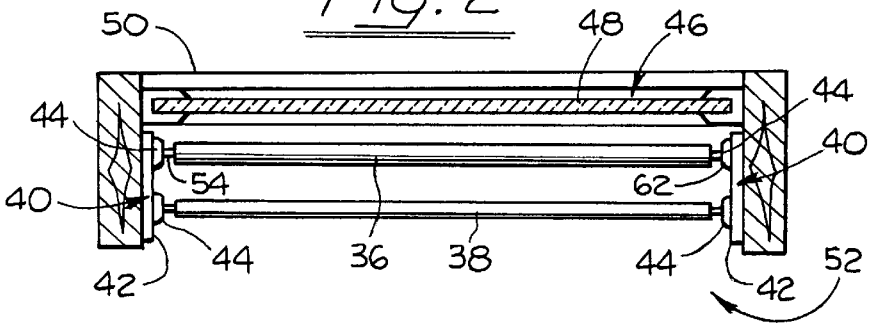
FIG. 2 is a view taken at line 2—2 of FIG. 1.
Figure 8:
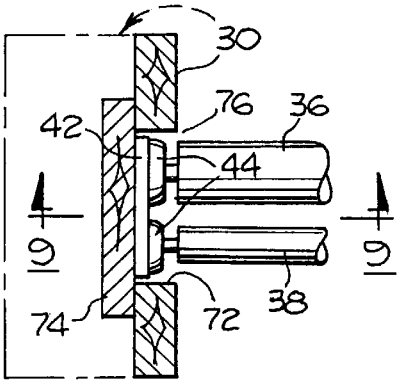

FIG. 8 is a view oriented according to the left hand end of FIG. 2, showing an alternate construction.

Figure 9:
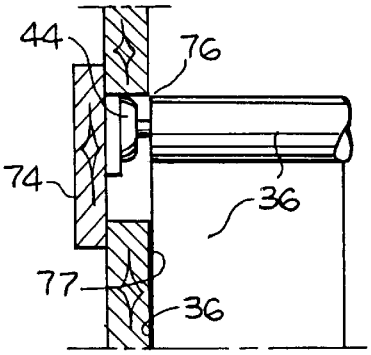

FIG. 9 is view taken at line 9—9 of FIG. 8.

Figure 10:
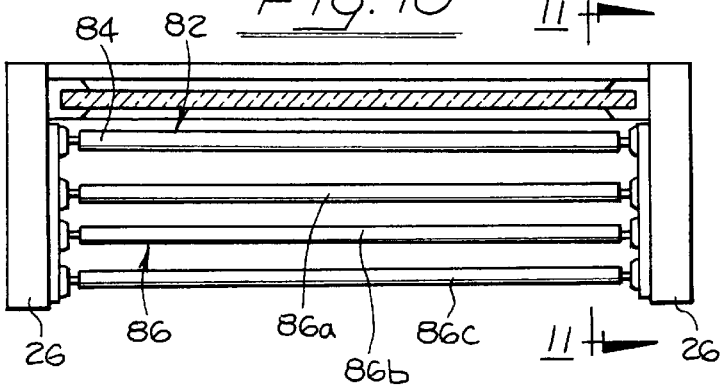

FIG. 10 is a view oriented according to FIG. 2 showing a plurality of decorative shades.

Figure 11:
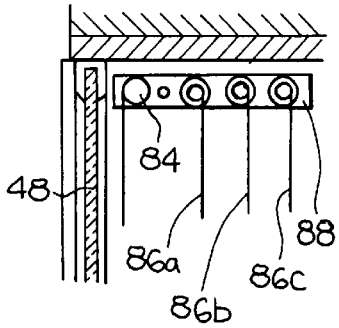

FIG. 11 is a view taken at line 11—11 of FIG. 10.

Figure 1:
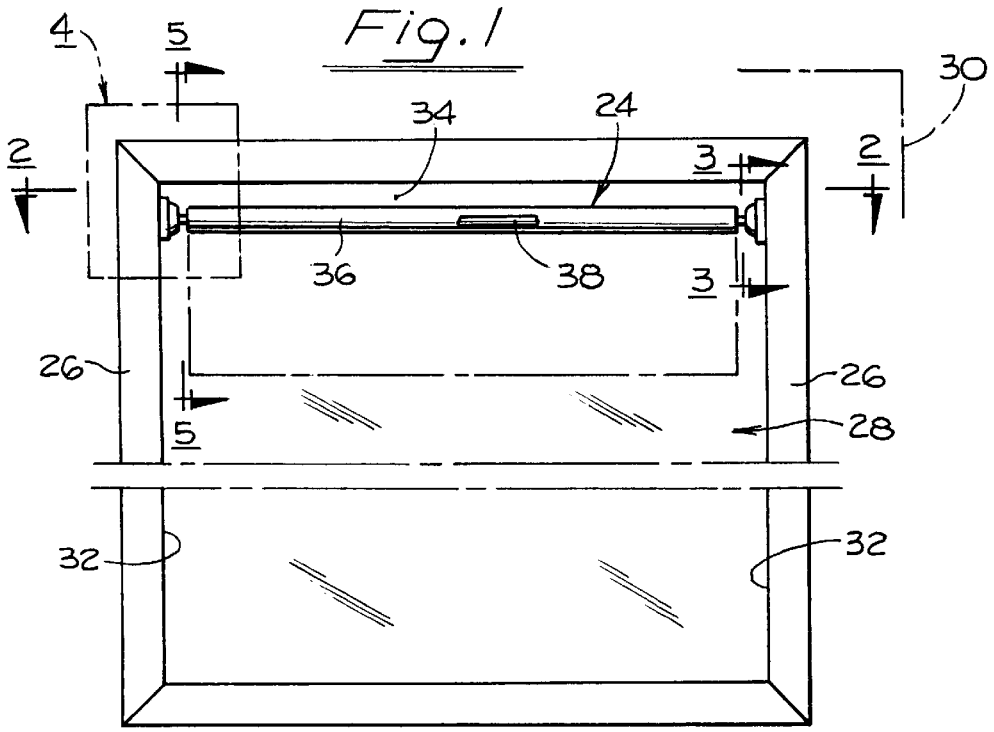
FIG. 1 is face view of a window frame in which the shade assembly of the invention is mounted.
Figure 12:
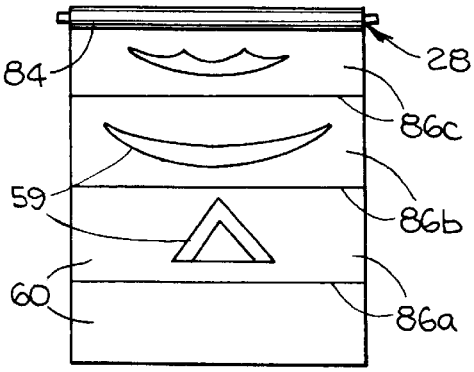

FIG. 12 is a face view, oriented according to FIGS. 1 and 6 showing a single main shade and a plurality of decorative shades with the latter drawn to different positions.

Figure 13:
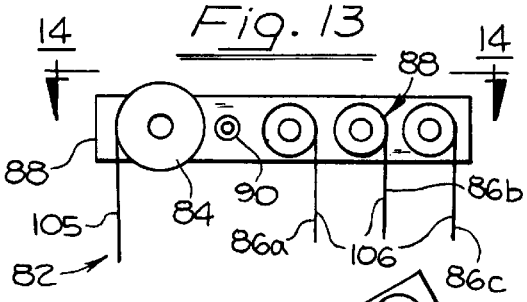

FIG. 13 is a view oriented according to FIG. 11 but showing the elements in larger scale.

Figure 14:
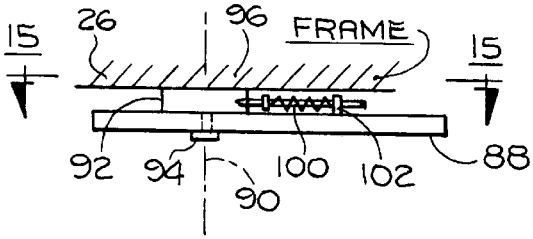

FIG. 14 is a view oriented according to line 14—14 of FIG. 13.

Figure 15:
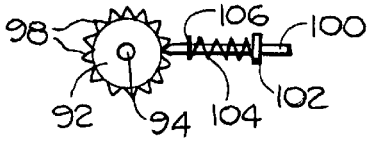

FIG. 15 is a view taken at line 15—15 of FIG. 14.

Figure 16:
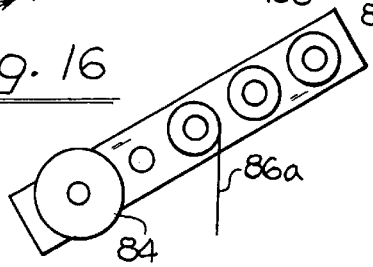

FIG. 16 is a view oriented according to FIG. 13 showing the lever mounting means therein in a different position.

Figure 17:
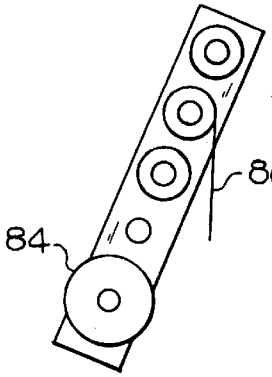

FIG. 17 is view similar to FIG. 16 showing the lever means in another position.

Figure 18:
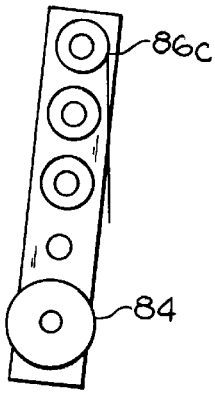

FIG. 18 is a view similar to FIGS. 16 and 17 showing the lever in a still different position.

Figure 19:
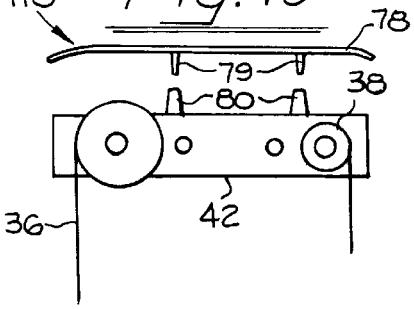

FIG. 19 is a semi-diagramtic view of assembly construction including a cover means for the shade assembly.

Figure 20:
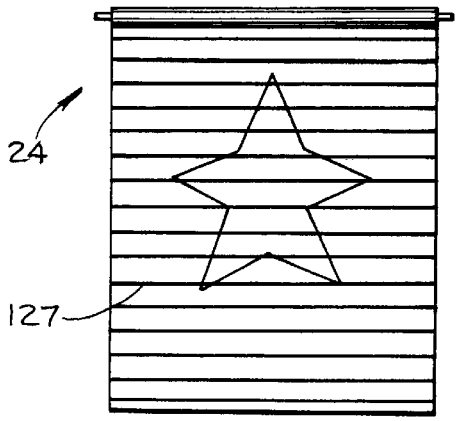

FIG. 20 is a view of the assembly in combination with a blind.

Figure 21:
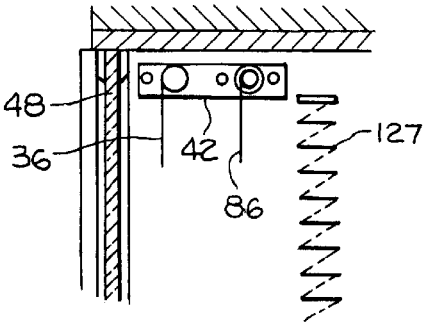

FIG. 21 is a side view of FIG. 20, in semi-diagrammatical form.

Figure 22:
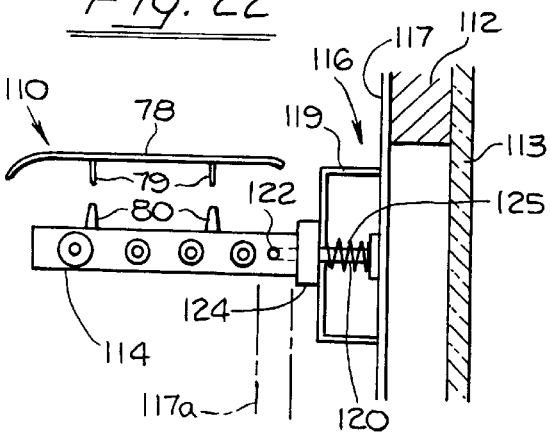

FIG. 22 is a vertical view showing a shade assembly mounted in an automobile.

Figure 23:
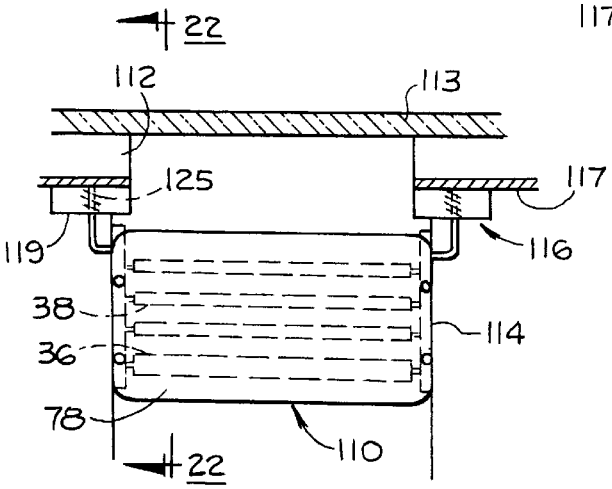

FIG. 23 is a top view of the device of FIG. 22, with the cover removed.

DETAILED DESCRIPTION OF THE DRAWINGS

The window shade assembly may be used in any of a great number of situations where it is desired to produce an unusual decorative effect. These situations may be in a house, or various public places. Examples of the latter may be hospitals, lobbies, schools, airports, churches, in lieu of stained glass windows, restaurants, as well as others.

Reference is made to the drawings showing specific forms of the device. The window shade assembly of the invention is indicated in its entirety at 24 in FIG. 1, mounted in a window frame 26 defining a window 28. The window is formed in a wall indicated diagrammatically at 30.

The window frame 26 includes vertical frame elements 32 on which the shade assembly is mounted as referred to hereinbelow. As is shown in FIG. 1, the shade assembly is mounted adjacent to the top of the window, leaving a space 34 which desirably is very small.

The shades of the assembly include a main opaque shade 36 and a decorative shade 38. The shade 38 is shown fully in FIG. 2, but only fragmentarily in FIG. 1. The shades are in the form of rolls, each containing a roller and a sheet rolled thereon, the sheets being rolled up on the roller in retracted position, and unrolled, in flat sheet form, when drawn to extended active position, this construction of shade being known. The two shades are mounted in mounting brackets 40 each of which includes a simple straight bar 42, and clips 44 of known kind, which accommodate the physical construction of the shades. The bar 42 is secured to the side frame 32 by suitable means such as screws 45.

Figure 3:
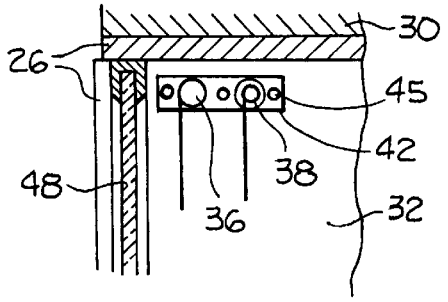
FIG. 3 is a view taken at line 3—3 of FIG. 1.

The shade assembly is mounted in the window frame adjacent to the usual window sash 46 (FIGS. 2, 3) which includes a glass pane 48. This window sash is normally positioned adjacent the exterior side of the window indicated at 50, the inner side being indicated at 52. The window shade assembly therefore is positioned inwardly of the sash, and preferably within the front to rear confines of the frame as indicated.

Each of the shades 36, 38 has an internal torsion spring arrangement (not shown) which includes an external pin 54 at one end, (FIG. 5) in the form of a flat blade. The flat pin 54 extends into a slot in the corresponding clip 44. In one form, the shades may be of the same size, i.e., same diameter of roller and same thickness of sheet. The main shade is opaque, and the decorative shade transparent.

Figure 4:
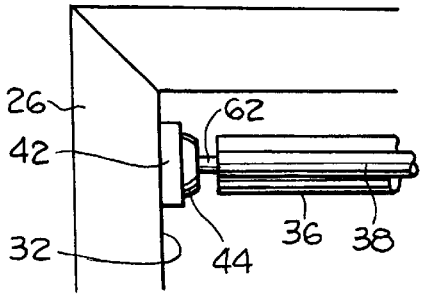
FIG. 4 is view of that portion surrounded by the dot dash rectangle 4, of FIG. 1, on a larger scale.

In another form, the decorative shade 38 may be made of film similar to photographic film, and therefore thinner than that of the main shade 36, the shade 38 in rolled form therefore being of less diameter than the rolled form of the main shade 36 as shown in FIGS. 2, 4, and if desired, the roller of the shade 38 may itself be of less diameter than that of the shade 36.

The film forming the sheet of the decorative shade 38 includes opaque portions or areas 59 (FIGS. 6, 12), and other portions or areas 60 that are more transparent, forming the decorative or artistic pattern 61 (FIG. 6). The pattern instead, if desired, may be formed by paint on a clear sheet. Preferably, the decorative shade is provided with a single FIG. 61, but as an alternative, it may be desired to form a plurality of small FIGS. 63 as in FIG. 6*a*.

FIGS. 5*a* and 5*b* show shades of the two kinds mentioned: FIG. 5*a* shows a shade 38 of film character and FIG. 5*b* shows a clear sheet with paint thereon forming opaque portions. In both cases the clear portions are indicated 60 and the opaque portions 59.

The decorative shade 38 may be made up of different colors as well as black and white, as desired.

Each of the rollers has a fixed round pin 62 which fits into a round hole at the end opposite the flat pin in the corresponding clip 44.

To counteract tendencies to displace the light weight shade 38, the lower edge is provided with a seam 64 FIG. 7 in which is placed a weight 66 of suitable material, such as metal, extending the width of the shade. This bar holds the shade down in straight vertical position.

The standard opaque roller shade 36 (FIG. 5) may also have a seam 68 in which is placed at the center (FIG. 1) an element 70, which need not act as a weight, but provides an enlargement for easy gripping of the shade.

As will be apparent, the shades 36, 38 are actuateable individually and selectively, each being utilized in drawn position while the other one is in retracted position.

As indicated above, the main opaque shade is intended to block out all outside light, but this is very seldom accomplished in practical conditions. To minimize accidental passage of light through the window when the assembly is in place and the main shade drawn, an inset arrangement may be utilized, shown in FIGS. 8 and 9. In this case the wall 30 has an aperture 72 therein, and a board piece 74 is secured to the wall on the inner surface thereof, closing the aperture. The mounting bracket bar 42 (FIGS. 2, 3) is secured to the board piece 74, and the bracket with the clips 44 is contained in the projection of the inner and outer surfaces of the wall 30. The main roller 36 is projected into the aperture, and the end edge of the roller closely approaches the corner of the wall formed by the aperture, as indicated at 76 (FIG. 8). In FIG. 9, the shade 36 is shown abutting the wall at 77, effectively completely blocking the exterior light from entering.

FIGS. 19 and 22 show a cover 78 applied to the assembly to prevent foreign particles from falling thereon. The bar 42 (at each end) is provided with prongs 80, and the cover 78 is provided with pins 79 at each end which detachably snap into the prongs, the cover thereby entirely covering the complete assembly.

The foregoing discloses a simple arrangement of a single main shade and a single decorative shade. However the invention is of such scope as to include an arrangement that has a single main shade and a plurality of decorative shades. This latter feature is shown in FIGS. 10–18 inclusive. In this arrangement the shade assembly 82 is similar in overall construction to the shade assembly 24 and is mounted in the window frame 20 in the same manner. However in the present case the assembly includes a single main opaque shade 84 similar or identical to the main shade 36, and a plurality of decorative shades 86, similar to the shade 38, individually identified 86*a*, 86*b*, 86*c*.

These shades are mounted in a pair of bars 88 at opposite sides of the window frame in the same manner as utilized in the first embodiment. The bar 88 is of greater length than the bar 42, and is mounted for pivotal swinging on an axis 90 (FIGS. 13, 14) in the window frame. These bars thus form levers, each lever having a first arm and a second arm on opposite sides of the axis, respectively. This mounting may be of any desired construction, including for example as a metal piece 92 secured to the frame 26 (FIGS. 14, 15). A screw 94 is extended through a hole in the bar 88 and the piece 92 and threaded into the window frame as indicated at 96.

The piece 92 has several indentations 98 in its periphery, and mounted on the bar 88 is a latching pin 100 slidable in a finger 102 on the bar. A compression spring 104 surrounds the pin 100 and is compressed between the finger 102 and a stop 106 on the finger. This spring biases the finger toward the piece 92, to the left as shown in FIG. 15, and detachably latches the inner end of the finger in the notches. This arrangement however enables the finger to be retracted in response to manual swinging of the bar about the axis 90, for positioning the bar in different positions as shown in FIGS. 13, 16–18. Such a latching means is provided at each end of the assembly.

The main shade 84 is so mounted that the sheet is drawn down on the outer side, i.e. nearest the exterior, or at the left side as viewed in FIG. 13, as indicated at 105, but the decorative shades 88 are arranged oppositely to that, with the sheets indicated at 106 coming down from the rollers on the inner side. FIGS. 16–18 show the bar 88 positioned in relatively different angular positions, and when it is desired for example to draw the shade 86*a*, the bar may be put in the position shown in 16; when it is desired to draw the next shade 86*b*, the bar is put in the position shown in FIG. 17; and when the innermost shade 86*c* is to be drawn, the bar is placed in the position shown in FIG. 18. The result of these different positionings of the bar results in the drawn shade being closer to the main shade 84, and thus the entire assembly is rendered more compact, with the drawn shade closely adjacent to the main shade 84 in all cases.

Another advantage of the present construction (FIGS. 13–18) is that it may be desired to draw several of the decorative shades to different extents as represented in FIG. 12. In this case the main shade 84 is fully retracted; and the other shades 86*a*, 86*b*, 86*c* drawn to various other positions, producing different combination patterns.

A further feature of the invention, is that the device may be mounted in association with a blind, having either vertical, or horizontal slats. FIGS. 20 and 21 show such an arrangement where the assembly 24 is mounted in the windowframe, as described above, between the window pane 48 and the blind 127. The main shade 36 may be raised to admit the light from the exterior, and the blind 127 set or adjusted to partial or full open position to expose the decorative shade 86 therethrough, the slats of the blind then taking part in the pattern cast in the room, or in viewing the pattern on the decorative shade, taking part in that pattern.

Another form of assembly 110 is illustrated in FIGS. 22 and 23 for mounting in a vehicle such as a car or automobile. In this case the wall of the car is indicated at 112 with a window 113 therein. The assembly includes a bar 114 at each end corresponding to the bars 42, the shades 36, 38, and the cover 78. The assembly further includes a bracket 116 having a back plate 117 and a shell 119. A pin 120 is pivoted at 122 on the bar 114 and is slidable in the shell. The bar has a plate 124 fitted against the shell, and a compression spring 125 biases the bar inwardly. The bar with the shades, is slidable outwardly, to a limited extent, enabling the bar and shades to swing downwardly to the dot-dash line position 114*a*, bringing the assembly to a collapsed position, freeing the space in the car for more head room.

What is claimed is:

1. A roller shade assembly for mounting in a window in a wall between the exterior and an inner room, the window having a frame with side members and a top member, the wall and thus the window having a rear directed to the exterior and a front directed to the room, comprising, parts which, when the assembly is so mounted in the window, are positioned, and which function, as set out hereinbelow, a main opaque shade, a decorative shade made up of opaque and transparent areas forming a pattern enabling light from the exterior to pass therethrough, thereby forming a pattern in the room, the shades being capable of being drawn and retracted, a pair of brackets for each shade, the brackets of each pair including counterpart brackets cooperating respectively with pins at opposite ends of the shades, for supporting the shades, and whereby each shade can be drawn and retracted independently of the others.

2. A roller shade assembly according to claim 1 and including, mounting bars for mounting in horizontal position on the side frame members respectively at the top of the window, and the brackets being mounted on the mounting bars, with those of each pair disposed on a common axis.

3. A roller shade assembly according to claim 1 wherein, the main opaque shade and the decorative shade are relatively positioned from rear to front.

4. A roller shade assembly according to claim 1 wherein, the decorative shade is made of photographic film having relatively opaque and light transmitting portions, for forming a visible pattern.

5. A roller shade assembly according to claim 1 wherein, the decorative shade includes a single item making up a pattern.

6. A roller shade assembly according to claim 1 wherein, the decorative shade includes a plurality of items making up a pattern.

7. A roller shade assembly according to claim 1 wherein, the decorative shade is made up of a clear sheet and paint applied thereto to form a pattern.

8. A roller shade assembly according to claim 1 in combination with, a blind having parallel slats rotatable on parallel axes for effectively moving them between closed touching positions and open spaced apart positions.

9. A roller shade assembly according to claim 1 wherein, the decorative shade:

has a horizontal width direction, is light in weight, includes an additional weight at the lower end thereon and extending the entire width thereof.

10. A roller shade assembly according to claim 1 and including, means mounting the shade assembly in the window frame adjacent the top of the frame, and covering means mounted on said mounting means in protective position over the shade assembly.

11. A roller shade assembly for mounting in a window in a wall between the exterior and an inner room, the window having a frame with side members and a top member, the wall and thus the window having a rear directed to the exterior and a front directed to the room, wherein, the assembly includes parts which, when the assembly is so mounted in the window, are positioned, and which function, as set out hereinbelow, the roller shade assembly comprising, a main opaque roller shade, a plurality of decorative roller shades, a plurality of pairs of brackets, including a pair for each of the shades, the brackets of each pair including counterpart brackets cooperating respectively with pins at opposite ends of a shade, a pair of levers, means for mounting the levers on the side frame members on a common axis adjacent the top of the window, the levers being so mounted with said axis positioned between the ends of the levers, that each lever has a first arm and a second arm, the brackets of one of said pairs being mounted respectively on the first arms, and the brackets of all the remaining pairs being mounted respectively on the second arms.

12. A roller shade assembly according to claim 11 wherein, the levers are pivoted on said common axis and thereby capable of adjustably positioning the shades horizontally toward and from a vertical reference plane containing said axis.

13. A roller shade assembly according to claim 12 wherein, each shade is in the form of a roll, and the shades when drawn reside in planes parallel with and adjacent to said vertical reference plane.

14. A roller shade assembly according to claim 11 and including, means for mounting said levers for selectively positioning them in a first position extending inwardly from the plane of the window, and a second position in which they extend downwardly in a vertical plane, adjacent the plane of the window.

* * * * *